US007854375B2

(12) United States Patent
Miyashiro

(10) Patent No.: US 7,854,375 B2
(45) Date of Patent: Dec. 21, 2010

(54) DEPOSIT BEVERAGE CONTAINER COUNTING DEVICE

(76) Inventor: Thomas Hidetaka Miyashiro, 55 S Judd St., Apt. 907, Honolulu, HI (US) 96817

( * ) Notice: Subject to any disclaimer, the term of this patent is extended or adjusted under 35 U.S.C. 154(b) by 0 days.

(21) Appl. No.: 12/586,415

(22) Filed: Sep. 21, 2009

(65) Prior Publication Data

US 2010/0072289 A1 Mar. 25, 2010

(51) Int. Cl.
*G06M 1/00* (2006.01)

(52) U.S. Cl. ..... 235/91 R

(58) Field of Classification Search ..... 235/91 R; 700/235

See application file for complete search history.

(56) References Cited

U.S. PATENT DOCUMENTS 4,395,625 A * 7/1983 Schutt ..... 235/98 C
2004/0158415 A1* 8/2004 Lowes et al. ..... 702/45
2010/0191369 A1* 7/2010 Kim ..... 700/235

* cited by examiner

*Primary Examiner*—Allyson N Trail
(74) *Attorney, Agent, or Firm*—Martin E. Hsia

(57) ABSTRACT

A deposit beverage container counting device in which containers can be visually inspected while sliding down an inclined feed channel having an abrupt downward bend of about 15 degrees to cause the containers to accelerate suddenly, singulating the containers; that is, creating or increasing the space between containers, which enables accurate counting. The singulated containers pass into a sensor housing that contains a photoelectric sensor that senses the passing of each container and sends a signal to one or more counters. The counter(s) keeps track of the count, and displays the count on a LCD or LED display. Multiple counters can be provided to enable both the operator and customers to see the count display. The electronic components are preferably low voltage, low current devices using transistorized circuits. The counting device preferably is battery-powered, and has no moving parts.

2 Claims, 14 Drawing Sheets

WITH LOADING BASKET 1 RAISED

TOP VIEW

WITH LOADING BASKET 1
IN LOWERED POSITION

LOADING BASKET
LIFTING MECHANISM

WITH LOADING BASKET 1 RAISED

WITH LOADING BASKET 1 RAISED

CONTROL PANEL 5

SENSOR HOUSING

FEED CHANNEL BREAK IN SLOPE 10

CONTROL PANEL

DEPOSIT BEVERAGE CONTAINER COUNTING DEVICE

FIELD OF THE INVENTION

The present invention relates generally to a deposit beverage container counting device.

BACKGROUND

Some states have instituted a deposit beverage container program, wherein the price of beverages sold in retail outlets includes a deposit fee for the container. This deposit fee may be 5 cents to 10 cents per container in most states that have such a program in operation. Empty deposit beverage containers, which can be of aluminum, steel, plastic or glass material, can be redeemed at redemption centers, where the containers are bought back for the deposit fee. These programs are established in the interest of increasing public participation in recycling and reducing the amount of recyclables in the waste stream, thereby reducing the amount of waste entering landfills.

Some states allow redemption of containers by weight. Where redemption value is determined by weight, consumers redeeming light plastic containers usually do not receive full refund value. Ideally, the only way to ensure that consumers can receive full refund value for their light plastic containers is to determine refund value by count. At the present time, counting of containers at redemption centers is done predominately by hand. This is a slow and laborious process that is prone to errors, especially with higher quantities.

Currently available devices and known prior patents relating to such counting devices are not amenable to the needs of a redemption center because they either involve complex machinery that would be too expensive for the typical redemption center to afford, and costly to maintain, or are designed for use by the consumer wherein containers are deposited one by one.

Advances in technology have produced photoelectric sensors that can accurately detect passing containers, but to the best of our knowledge, there is as yet no device that will meet the needs of redemption centers for simple, fast and reliable counting of containers, and that supports compliance with redemption procedures which normally require visual inspection of the containers before they are accepted and counted. U.S. Pat. Nos. 4,091,725 and 4,141,493 to Arp and U.S. Pat. No. 4,248,334 to Hanley are examples of patents that incorporate the use of electronic counting, however these devices are generally part of more complex machines, thus being inappropriate and too costly to be used in a redemption center operation. U.S. Pat. No. 4,545,062 to Pray incorporates photoelectric sensors to count containers, but this device is designed for use by consumers to deposit containers one by one. It also is not appropriate for use in redemption centers because it is designed to receive cans only, and uses the counter to provide a signal when the collecting bin is full. The present invention is designed to count beverage containers of all material types; i.e., aluminum and steel cans and plastic and glass bottles. The use of a loading mechanism that feeds containers onto a feed chute in a controlled manner allows the operator to guide the moving containers into the sensor feed channel and to inspect the containers before the containers are counted.

One of the primary causes of inaccurate counting by devices using photoelectric sensors is the lack of separation between containers as they pass through the sensor beam.

This lack of separation can result in the sensors sensing contacting or nearly contacting containers as one container.

SUMMARY OF THE INVENTION

The primary object of the present invention is to provide a novel and improved method of counting deposit beverage containers which consists of a loading basket in which containers to be counted are placed and from which containers are fed by gravity to slide along their longitudinal axes onto a downwardly inclined feed chute, where the containers then slide around a 90 degree bend towards a feed channel. Vibrator motors are preferably installed at strategic locations on the loading basket and the feed chute, which can be switched on by the operator to encourage smoother movement of the containers from the loading basket onto the feed chute and facilitate the sliding of containers down the feed chute. The 90 degree curve in the feed chute is designed to encourage the containers by centrifugal force to flow in single file. While the containers are sliding down the feed chute, the operator also guides the containers to preclude jams and to move in single file onto the downwardly inclined feed channel, which then feeds the containers through the sensor housing. The photoelectric sensor in the sensor housing senses the passing of the containers and sends signals to the counter, which receives the signals and increments the count by one for each container and updates the total displayed on a LCD or LED display. The loading basket is raised above and inclined toward the feed chute by means of a pulley system that allows the operator to control the elevation and angle of inclination toward the feed chute by means of a foot pedal. A door is preferably provided in the lower back portion of the loading basket opposite the end connected to the feed chute. This door allows the operator to dump the containers back into the customer's container in the event that the customer changes her mind and does not want her containers counted, or the operator rejects the load. This could happen for a variety of reasons, including but not limited to, containers having excessive contamination and the containers are not all valid deposit containers. The present invention provides a means to quickly and accurately count empty containers without the need to expend a great amount of time and energy, as is required if the counts were to be accomplished by hand. For a presently preferred second embodiment of the present invention, the loading basket is replaced by a load cradle, which is a frame designed with curved tubular arms that conform to and securely grasp a barrel into which empty beverage containers are placed. Preferably, the barrel is a plastic barrel of the size and design typically used at redemption centers, but any structure that holds empty beverage containers constitutes a barrel. When operating in windy conditions, the plastic barrel can be secured to the cradle using rope or cable. These plastic barrels have about a 32-gallon capacity. Containers to be counted are placed in the plastic barrel, which is then placed on the load cradle. The load cradle is raised around a hinged joint between the load cradle and the feed channel, using a large pulley, which is controlled by a hand-operated pulley system in lieu of the foot-pedal system used in the initial preferred embodiment. This hand-operated system preferably also has a position retaining system that allows the operator to release the lift lever and still retain the load cradle in the raised position, so that the operator to use both hands, when necessary, to manipulate the containers and clear jams. This position retaining system can be a pair of friction discs coaxially mounted with the lifting lever and the pulley: a stationary friction disc attached to the support structure for the lifting lever, and a rotating friction disc attached to the shaft of the lifting lever, whereby the friction discs can be compressed together when desired to provide friction that can be sufficient to retain the load cradle in the raised position. However, any alternate means for retaining the load cradle in the raised position, when desired, can be used, such as a ratchet and pawl, such alternate means being well within the skill of the ordinary artisan, and the choice of which means to use is not critical. The present load cradle design facilitates the container handling operation by using the plastic barrels that are normally used to temporarily hold the containers being redeemed. The present hand-operated lever lifting mechanism is significantly simpler than the foot-pedal system, and has much fewer moving parts. The previous foot-pedal system resulted in foot and leg fatigue after sustained operation of the counter. Another change in the presently preferred second embodiment is the use of a single straight feed channel, with the abrupt change in downward inclination in the feed channel (instead of a feed chute having an approximately 90 degree curve leading to a feed channel having a downward break in inclination). The use of vibrators is optional, but is not preferred in the presently preferred second embodiment. All other design features, such as the use of photoelectric sensors and counters with large and small displays, are retained in the presently preferred second embodiment of the present invention.

Another object of the present invention is to provide a novel and improved method of counting deposit beverage containers as a means to alleviate the problem being experienced, primarily with plastic bottles, wherein the redeeming customer does not always receive full deposit refund value when container loads are redeemed based on weight.

Another object of the present invention is to provide a novel and improved method of counting deposit beverage containers by providing a counting device that is portable and fully self-contained such that it can be used by redemption centers anywhere, including remote areas where AC electric power is not available.

Another object of the present invention is to provide a novel and improved deposit beverage container counting device that allows the operator to accomplish the counting of containers without the need to repeatedly bend over and to grasp each and every container as is normally needed when counting containers by hand, thus avoiding or reducing repetitive motion injuries. The present invention includes a loading mechanism that will feed the containers onto the inclined feed chute on which the containers will slide toward the operator as it approaches the feed channel, allowing the operator to guide the containers into the feed channels with minimal bending and reaching required. From the operator's operating position, the operator can inspect the containers and move the acceptable containers into the feed channel and simultaneously controlling the loading basket with the foot pedal, with minimal need to move or bend over, such that the operator can perform the required functions standing erect or sitting on a stool. Unacceptable containers can be ejected into a separate container with a flick of the wrist. This feature will significantly reduce the time and effort expended by the operator, and will greatly contribute to the operator's ability to provide good customer service.

Another object of the present invention is to provide a novel and improved deposit beverage container counter that provides reliable and virtually maintenance-free service for deposit beverage container redemption centers that need to accurately and quickly count containers being redeemed by consumers. By incorporating solid state components in a counting device that has no moving parts, there are no mechanical parts that would normally require maintenance and repair, and the operating life of the components is indefinite. As such, the present invention is expected to perform reliably and accurately for a long time. If components need to be replaced due to damage or malfunction, they are relatively inexpensive and available off-the-shelf from major vendors that can be found on the internet, or from local distributors in some areas.

Another object of the present invention is to provide a novel and improved method of counting deposit beverage containers with maximum reliability and accuracy with the use of a photoelectric sensor that can sense the passing of any type of object, including clear plastic and glass bottles. The present invention preferably incorporates the use of a retro reflective type photoelectric sensor, which contains a light emitting and receiving unit, and a special corner cube reflector. The sensor emits a narrow red beam to the reflector. The receiver circuit in the sensor includes a transistor switch that momentarily closes the normally open circuit when it senses a disturbance of the reflected light beam by a passing object, such as a container. In the industry, this is sometimes called a "dark on" setting of the receiver. The counter, which is connected to the sensor by wire, detects the momentary "dark on" signal from the receiver, and increments the count by one, and displays the running total count on its LCD or LED display. This retro reflective optical sensor with solid state circuitry is very reliable and accurate, as long as the objects being counted are separated sufficiently to allow the sensor to sense a "no container" condition in the space between each container. This requirement is accomplished by the use of an abrupt increase in the slope of the feed channel, which is discussed elsewhere. These photoelectric sensors are readily available from various distributors found on the internet, and are relatively inexpensive. If any sensor malfunctions due to damage or component failure, which would be unusual, it can be easily replaced. In the prototype, these sensors are rectangular, about one inch (2.54 centimeters) wide by three inches (7.62 centimeters) high and three inches (7.62 centimeters) deep, however, the sensors can have various other shapes and sizes. The light emitter and receiver windows are located on the narrow face and are oriented to create a beam perpendicular to the axis of the feed channel. The sensor is mounted in the sensor housing in a steel sheet metal bracket that keeps the sensor pointed exactly at the reflector.

Another object of the present invention is to provide a novel and improved deposit beverage container counting device that is accurate without adding complexity to the design and operation of the device, by the incorporation of an abrupt increase in the angle of downward inclination of the feed channel. One of the primary causes of inaccurate counting by devices using photoelectric sensors is the lack of separation between containers as they pass through the sensor beams. This lack of separation can result in the sensors sensing the contacting or nearly contacting containers as one container. This can happen if the sloped feed channel has a fixed or decreasing angle of downward inclination. The novel remedy to this possible cause of inaccurate counting is the abrupt increase in the downward slope of the feed channel. The inclined feed channel contains a break in the slope that abruptly increases the angle of downward inclination as the channel approaches the sensor housing. This abrupt increase in downward slope causes the moving containers to accelerate to a higher velocity and results in creation or increase in the separation between containers before they enter the sensor housing. This creation or increase in separation is caused by the force of gravity alone, and allows the device to singulate the containers and ensures that each container will be counted.

Another object of the present invention is to provide a novel and improved deposit beverage container counting device that supports and enables the redemption center operator to comply with redemption procedure requirements, which usually include the requirement that containers be visually inspected to verify that the containers are in fact deposit beverage containers, and to inspect for contamination and evidence of prior processing, which would indicate that the containers had been previously redeemed. With the use of the feed chute, the operator must guide the sliding containers onto the feed channel by hand. Because the present invention allows the operator to expend minimal time and energy on the counting of the containers, he/she can devote more attention to inspecting the containers and serving the customers.

Another object of the present invention is to provide a novel and improved deposit beverage container counting device that provides a means to count deposit beverage containers of various sizes and materials. The design and size of the feed channel and the interior dimensions of the sensor housing can be set to accommodate various sizes of containers up to but not necessarily limited to 2 liter plastic bottles. Beverage containers of all materials, i.e., aluminum and steel cans, and plastic and glass bottles, can be counted in this device.

Another object of the present invention is to provide a novel and improved counting device that provides a means to count other types of objects that require inspection before being accepted and counted, including but not limited to used golf balls, fruits and other spherical or cylindrical objects that are less than 4 inches (10.16 centimeters) in diameter and about 12 inches (30.48 centimeters) in length.

Another object of the present invention is to provide a novel and improved deposit beverage container counting device that enables both the redemption center operator and the redeeming consumer to observe the counting process and to see the count totals on the counter LCD or LED numeric display.

DETAILED DESCRIPTION OF THE PREFERRED EMBODIMENT

The beverage container counting device is described in detail as follows.

Figure 1:
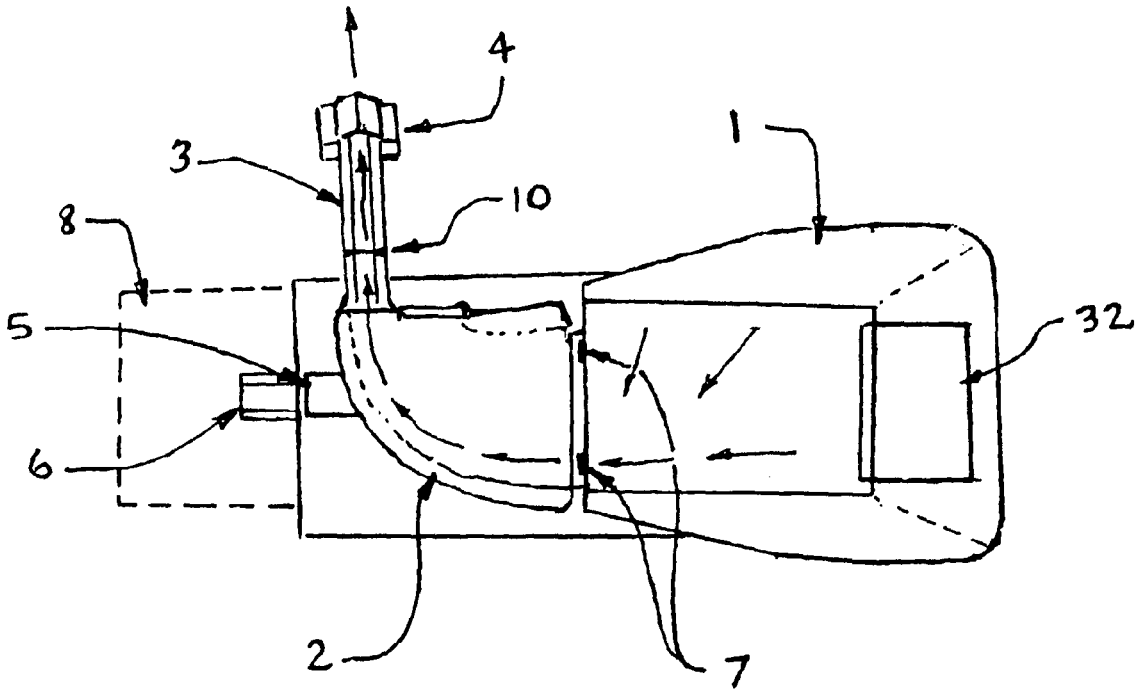
FIG. 1 is a top plan view showing the major components and the operator station.

FIG. 1 is a top view of the present invention showing the major container handling components. Containers to be counted are loaded into the loading basket 1, which can be made of a light and fairly rigid material such as fiberglass and injection molded plastic. A door 32 is provided to allow the operator to dump containers back into the customer's container if needed. The loading basket 1 is raised and rotated around hinges 7 at the juncture with the feed chute 2, which also can be made of a light, fairly rigid material such as fiberglass and injection molded plastic. As the angle of inclination of the loading basket 1 toward the feed chute 2 is increased, containers will start to slide onto the inclined feed chute 2. The elevation and inclination angle of the loading basket is controlled by the operator by way of the foot pedal 6. Vibrators 20 (on FIG. 2.) are installed at strategic locations on the loading basket 1 and on the feed chute 2 to encourage the smooth flow of containers from the loading basket 1 to and through the feed chute 2. The operator can switch on the vibrators 20 (on FIG. 2) when needed by flipping the toggle switch 23 (on FIG. 6) on the control panel 5. The operator working at the operator station 8 also guides the containers sliding down the feed chute 2 into single file and into the feed channel 3, which can be made of a light, rigid material, such as sheet aluminum and injection molded plastic. While doing this, the operator is also visually inspecting the containers to verify that they are valid deposit containers and they do not contain significant contamination. Once on the feed channel 3, the containers quickly slide through the sensor housing 4, which can also be made of light, rigid material such as sheet aluminum and injection molded plastic. A plastic liner 33 (on FIG. 7) is installed in the feed channel to provide a smooth and low-friction surface that is easy and inexpensive to replace when needed. The liner used in the prototype is derived from inexpensive rain gutters available from the local hardware stores. Alternatively, a sheet aluminum channel can be used, and the sliding surfaces can be coated with a coat of powdered polyurethane, which has been melted and cured with a heat lamp into a hard, smooth coating. Applying wax to this coating results in a slippery surface, which is needed for optimum performance of the feed channel. The feed channel 3 contains a break in slope (10 on FIG. 1 and FIG. 8) that abruptly increases the slope by about 15 degrees, but can be more or less depending on desired velocities and space arrangement restrictions. When constructing the feed channel with rigid materials such as sheet aluminum, the break in slope would normally be the joining of two straight channels or the joining of a few short, mitered sections of channel to form a segmented curve consisting of sections of straight channel. If the channel is made using the injection molding process or other similar process where material in a liquid state, such as molten plastic or fiberglass resin, is cast into parts using forms, the break in slope could be a short curved section. Whichever material and method is used is considered a commercially viable variant. The abrupt increase in slope causes the containers to accelerate to a higher velocity and results in creation or increase in the space between containers before they enter the sensor housing 4. This creation or increase in space between containers is critical to the accuracy of the counter.

Figure 2:
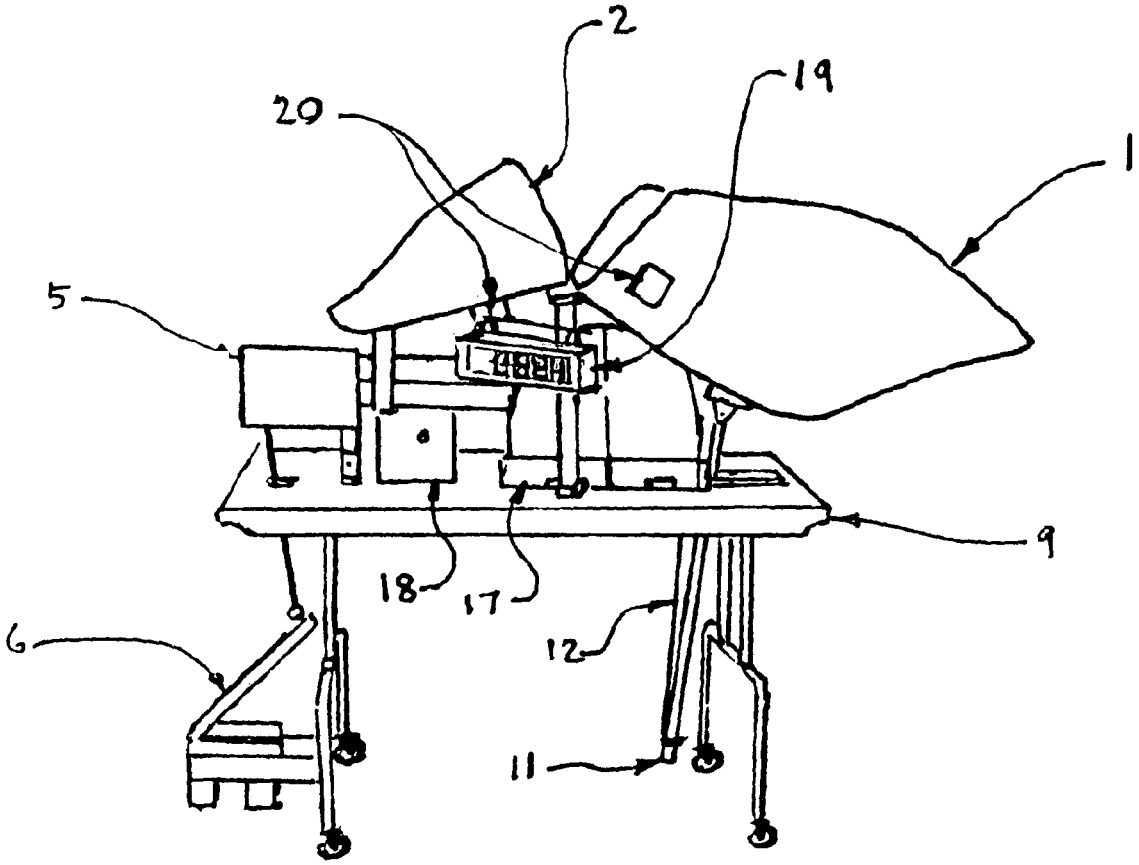
FIG. 2 is an elevation view of the left side of the counting device with the loading basket in the lowered position.

FIG. 2 is a side view from the left side showing the major components on the left side of the counter. The loading basket 1 is in the lowered position. A table 9 with folding legs provides the platform for the counter. The table legs preferably have casters installed to provide mobility. Also shown are the battery box 18, in which the battery is stored, the large counter display 19 and the vibrators 20.

Figure 3:
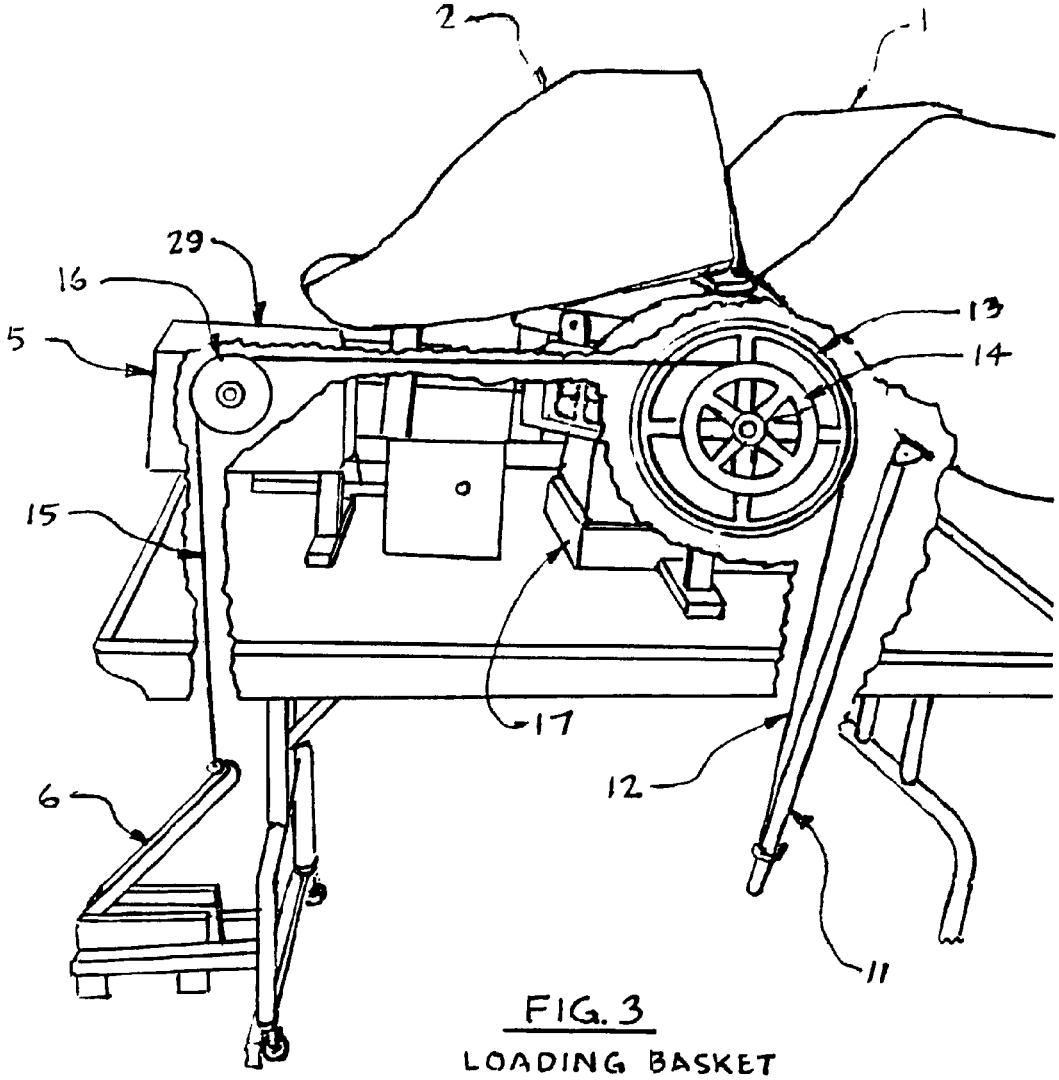
FIG. 3 is a cut-away view showing the loading basket lifting mechanism.

FIG. 3 is a cut-away view showing the loading basket lifting mechanism. The lifting mechanism is comprised of a lifting rod 11 connected to the bottom of the loading basket. The lifting rod is raised by a 3/16 inch steel cable with vinyl covering 12 attached to the bottom end of the lifting rod 11. The other end of the cable 12 is connected to a 15 inch (38.1 centimeter) diameter metal sheave 13 fixedly attached to an 8 inch (20.32 centimeter) diameter metal sheave 14. Another cable 15 connected to the 8 inch (20.32 centimeter) diameter sheave leads to a foot pedal 6 via a 5 inch (12.7 centimeter) diameter metal sheave 16, located behind the control panel 5. A cover 17 is provided to protect the 15 and 8 inch sheaves from the weather and dirt and grime that accumulates with time. The 5 inch sheave is enclosed in a box 29, which also serves as the control panel on the side facing the operator. The cover 17 and box 29 can be made of light, rigid materials such as aluminum sheet, fiberglass and injection molded plastic. The lifting mechanism is simple in design, but provides the mechanical advantage of having a relatively small movement of the foot pedal result in a large movement of the loading basket. This is achieved by the use of different diameter sheaves 13 and 14 that are fixedly attached to each other.

Figure 4:
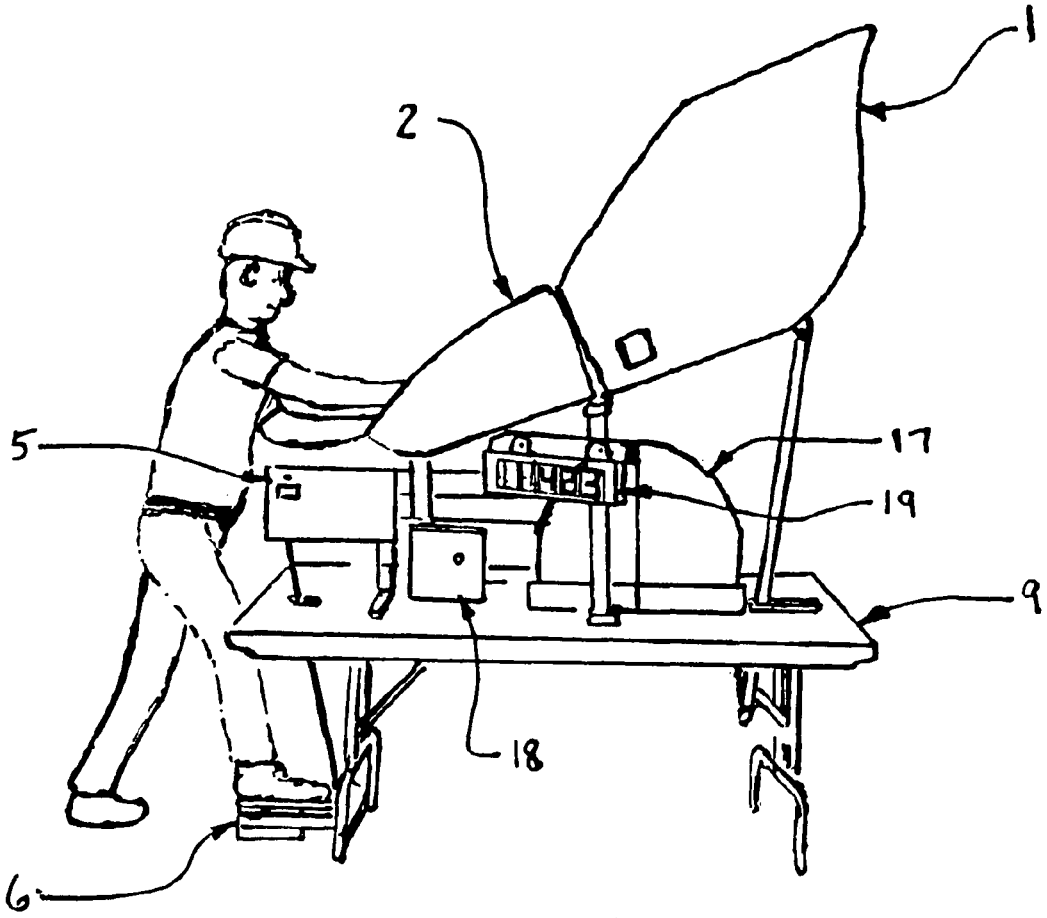
FIG. 4 is a side view of the left side of the counting device with the loading basket in the fully raised position.

FIG. 4 is a side view from the left side, with the loading basket 1 in the fully raised position, with the foot pedal 6 fully depressed by the operator.

Figure 5:
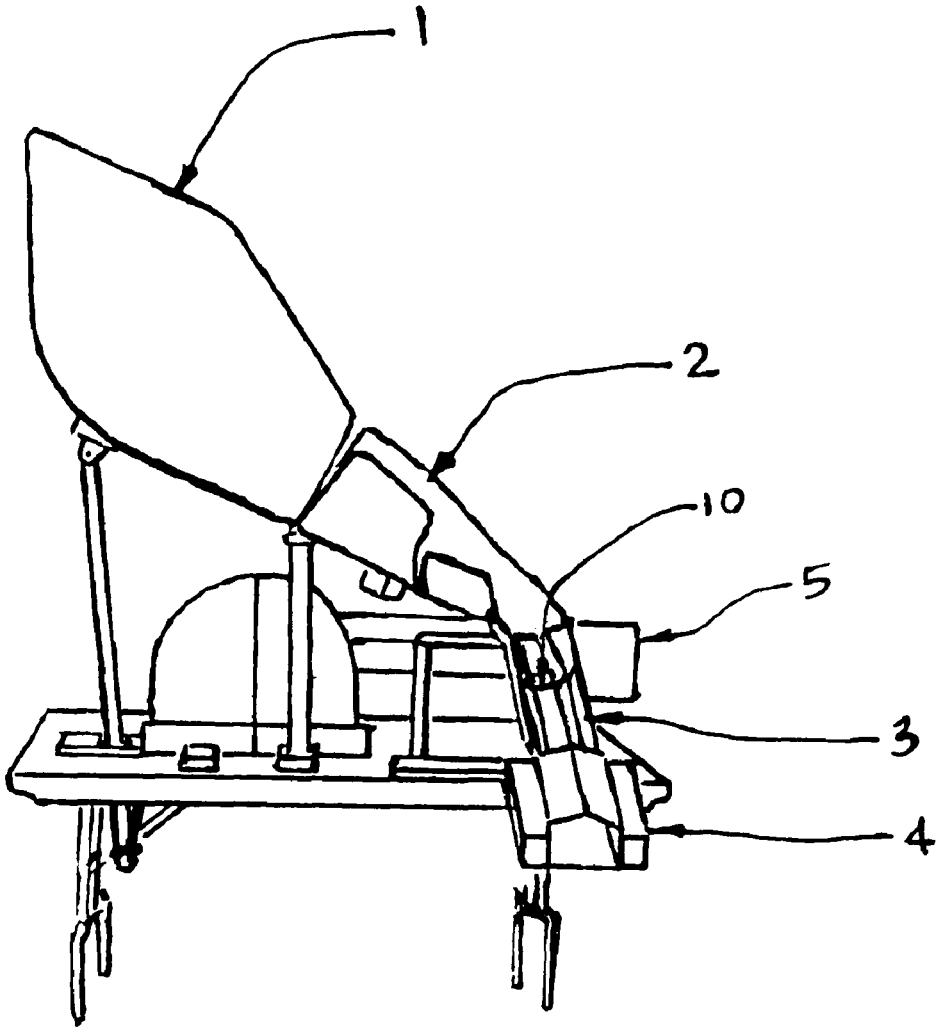
FIG. 5 is a side view of the right side of the counting device, showing the feed channel and sensor housing.

FIG. 5 is an elevation view from the right side with the loading basket raised. This view shows the feed chute 3 and the sensor housing 4. See FIG. 7 for a close-up view of the sensor housing 4. When a container passes through the sensor housing 4, a photoelectric sensor 30 (of FIG. 7) detects this passing, and sends a signal to digital counters 21 (of FIG. 6) and 19 (of FIG. 2), the digital counters increment the count by one and display the running total on a numeric display. The counter 21 (on FIG. 6) located in the control panel 5 displays the count on a small LCD display (about ½ inch high). A counter with a large display 19 located on the left side (see FIG. 2) also increments the count by one and displays the count on a large, 2¼ inch high LED display. This large display allows the customers to easily see the count from a safe distance.

Figure 6:
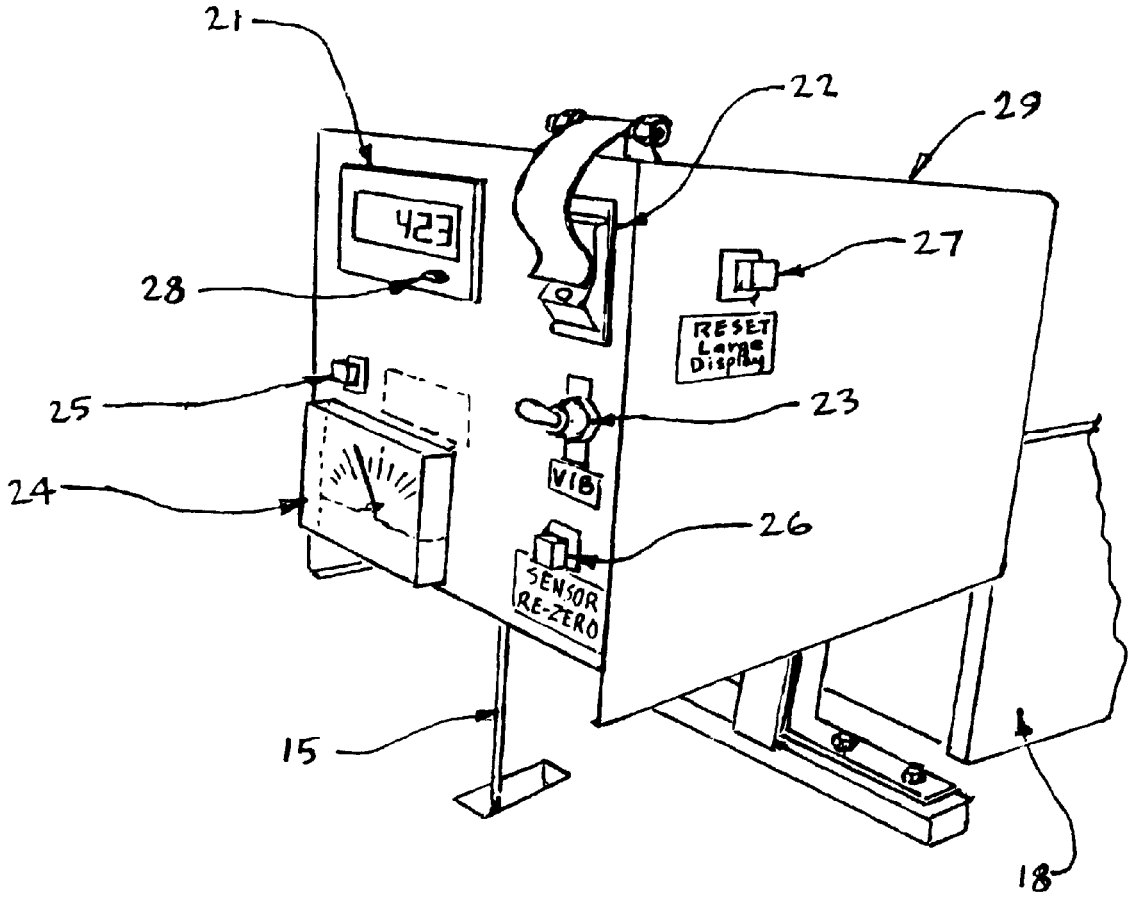
FIG. 6 is a frontal view of the control panel.

FIG. 6 is a frontal perspective view of the control panel 5 that allows the operator to control the operation of the counter conveniently from the operator station 8. Shown is the counter with the small LCD display 21, which provides a count reset switch 28, which resets the count to zero; the main power switch with protective cover 22, which has a light that illuminates when switch is on; a toggle switch for the vibrators 23; a battery level meter 24 and a push button switch to activate the battery level meter 25.

Figure 7:
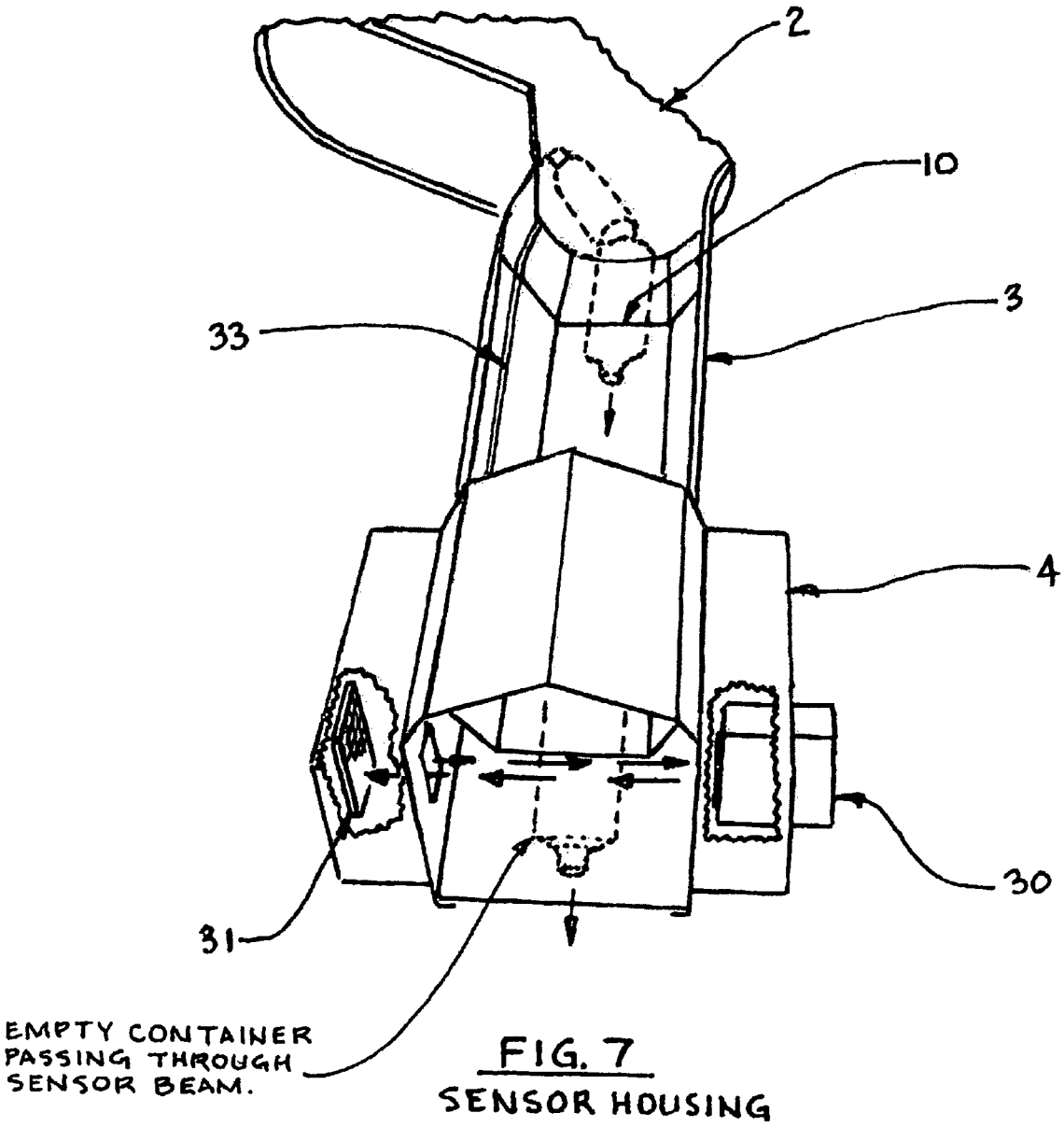
FIG. 7 is a close-up view of the sensor housing, showing the photoelectric sensor and reflector.

FIG. 7 is a close-up view of the sensor housing 4 from the discharge end. Containers are shown with dashed lines to illustrate the flow through the feed channel 4. The plastic liner 33 installed in the feed channel 3 is also shown. The retro reflective type photoelectric sensor 30 is installed on one side of the channel, and a special reflector 31 is installed directly opposite the sensor on the other side of the channel. This sensor 30 is a state-of-the art device that can accurately detect clear bottles. The sensor 30 emits a narrow light beam and receives the reflected beam from the reflector 31, as illustrated. The sensor 30 is calibrated for the "no container" or "zero" condition. Any disturbance of this "no container" condition followed by a return to the "no container" condition will be read as the passage of one container, and triggers a voltage impulse that is sensed by the counters. The return to the "no container" condition is sensed by the sensor 30 in the space between the containers. If there is no space between containers, the sensor 30 will "read" the contacting containers as one container, which is why it is critically important that there is a space between containers when the containers enter the sensor housing 4, that is, that the containers are singulated. The separation between containers is increased or created (that is, the containers are singulated) by the break or change in slope of the channel 10. This is discussed in more detail elsewhere in this document. The counters then increment the count by one and display the count on LCD or LED display. The sensor 30 can be "re-zero'd" remotely be pushing a button 26 (on FIG. 6) on the control panel 6, shown in FIG. 6. This ensures that the sensor 30 is properly set and ready to accurately detect the containers.

Figure 8:
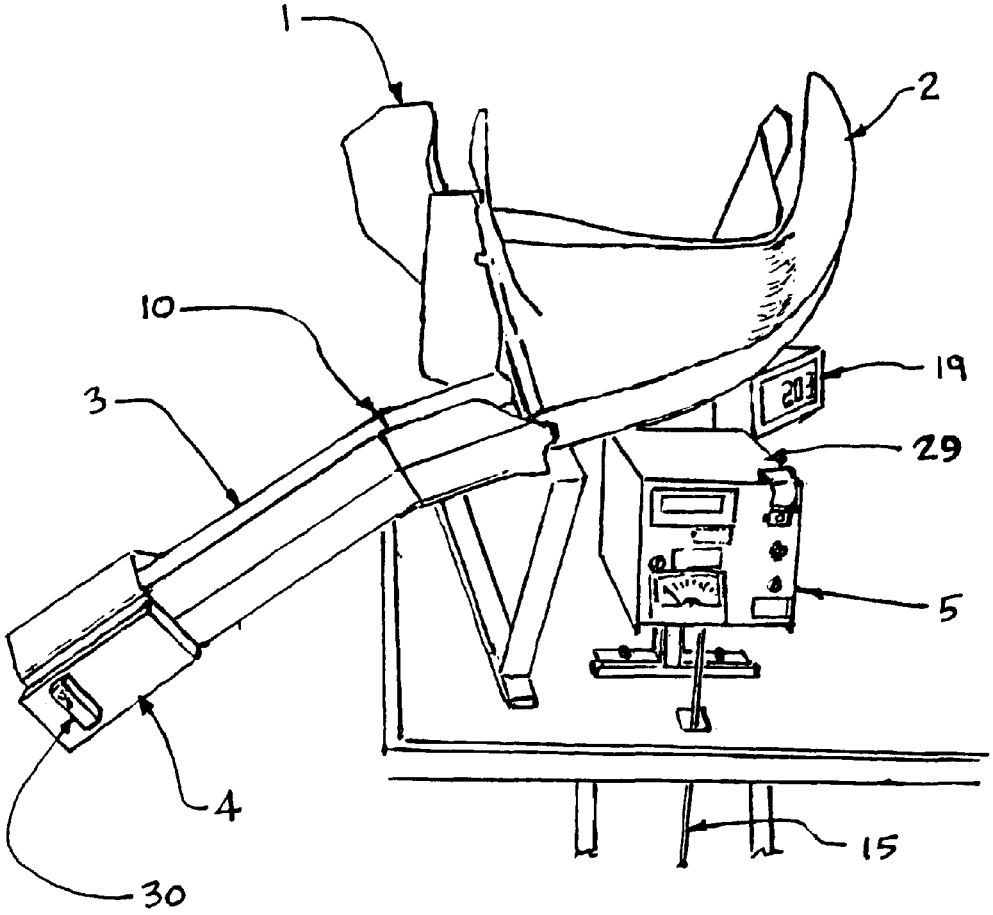
FIG. 8 is an elevation view showing the break in slope in the feed channel.

FIG. 8 is a side elevation view showing the break in slope 10 in the feed channel 3. Containers guided onto the feed channel 3 must be in single file but may have little or no space between containers. Once moving down the feed channel 3, the containers flow over the break in slope 10 and are accelerated by the increased slope to a higher velocity. This relative increase in the velocity between containers is the result of the constant force of gravity acting on the containers as the angle of inclination of the feed channel 3 is increased.

Figure 9:
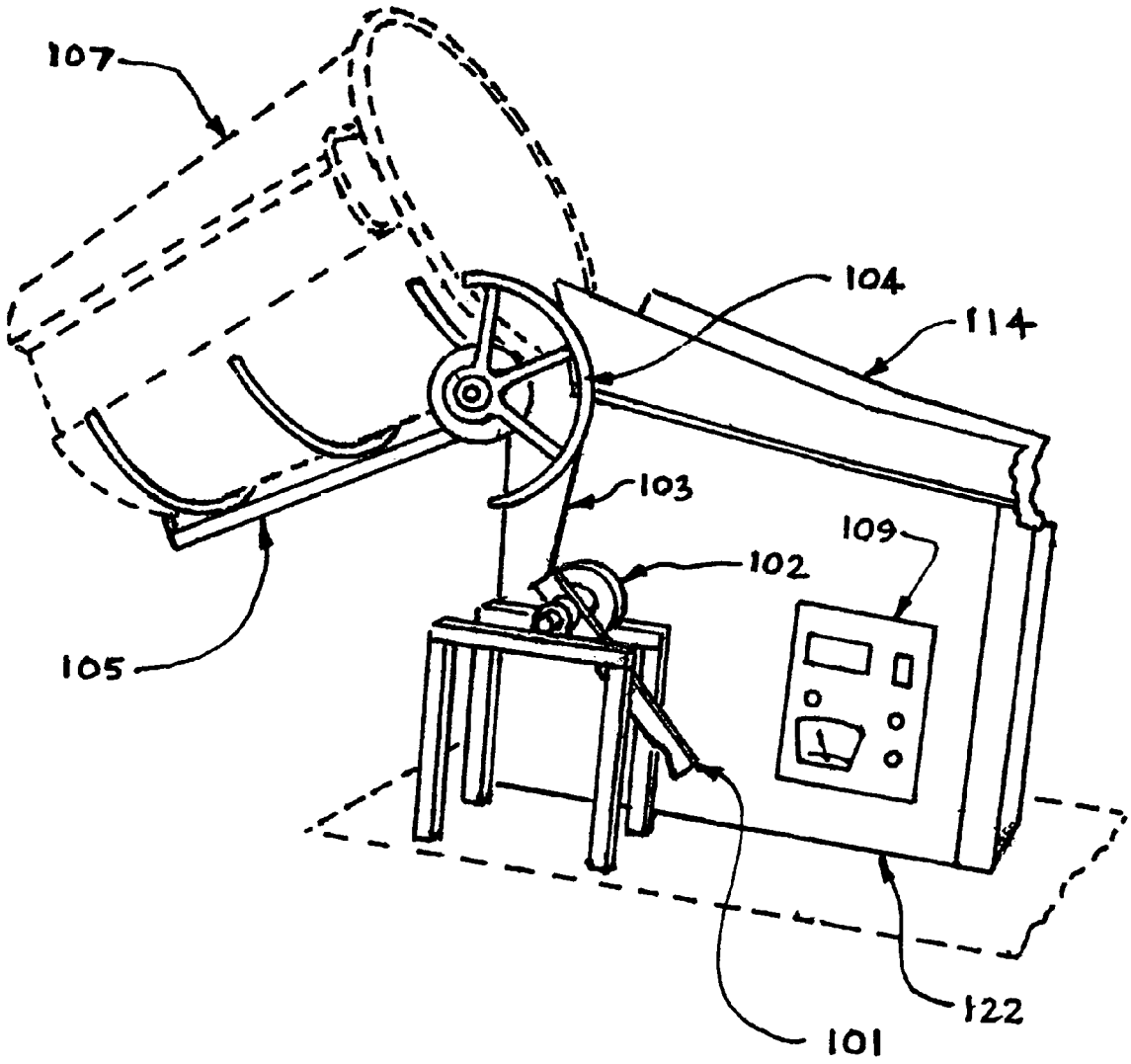
FIG. 9 is a side perspective view of the loading cradle portion of a preferred alternative embodiment of the invention.

FIG. 9 discloses a presently preferred alternative embodiment of the present invention in which the loading basket 1 is replaced with a load cradle 105. A presently preferred hand-operated lifting mechanism (with covers removed) for the load cradle 105 is disclosed. The lift lever 101 is directly connected to a 5 inch (approximately) diameter pulley 102, which rotates counterclockwise to pull on cable 103, which turns the large pulley 104 clockwise. The large pulley is connected to the load cradle 105, and the clockwise rotation of the large 14-inch (approximately) diameter pulley 104 causes the load cradle 105 to rotate around a hinged joint, 106 (in FIG. 10). The difference in pulley sizes provides mechanical advantage (leverage) that makes it easier to move the lift lever 101 to lift the load cradle 105 and the plastic barrel 107 containing the containers to be counted. As the load cradle 105 rotates up, it is raised above the feed channel 114 (see FIG. 10), until containers start to flow onto the feed channel 114.

Figure 10:
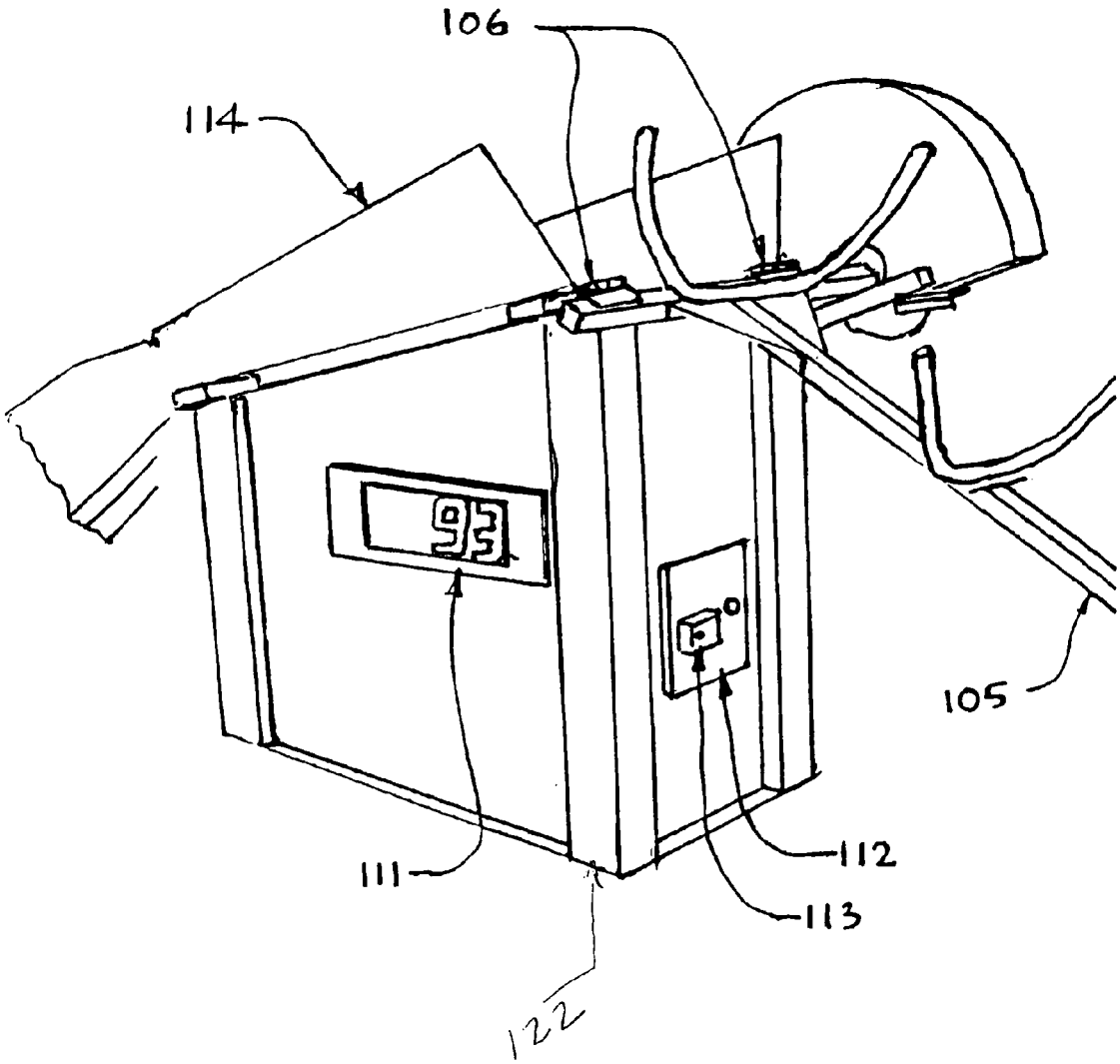
FIG. 10 is a diagonal perspective view thereof.

Referring to FIG. 10, the counter is preferably viewed from the customer's side, showing the large display counter 111. The battery box 112, preferably containing a 12 volt rechargeable battery, and the low voltage alarm 113 are shown mounted on a sheet aluminum base 122. The load cradle 105 is designed to accept the sizes of plastic barrels typically used in redemption centers (32-gallon size). Other sizes can be used; the load cradle length can be adjusted if required to accept different sizes. During windy periods, the plastic barrel can optionally be secured to the load cradle with a rope or cable.

Figure 11:
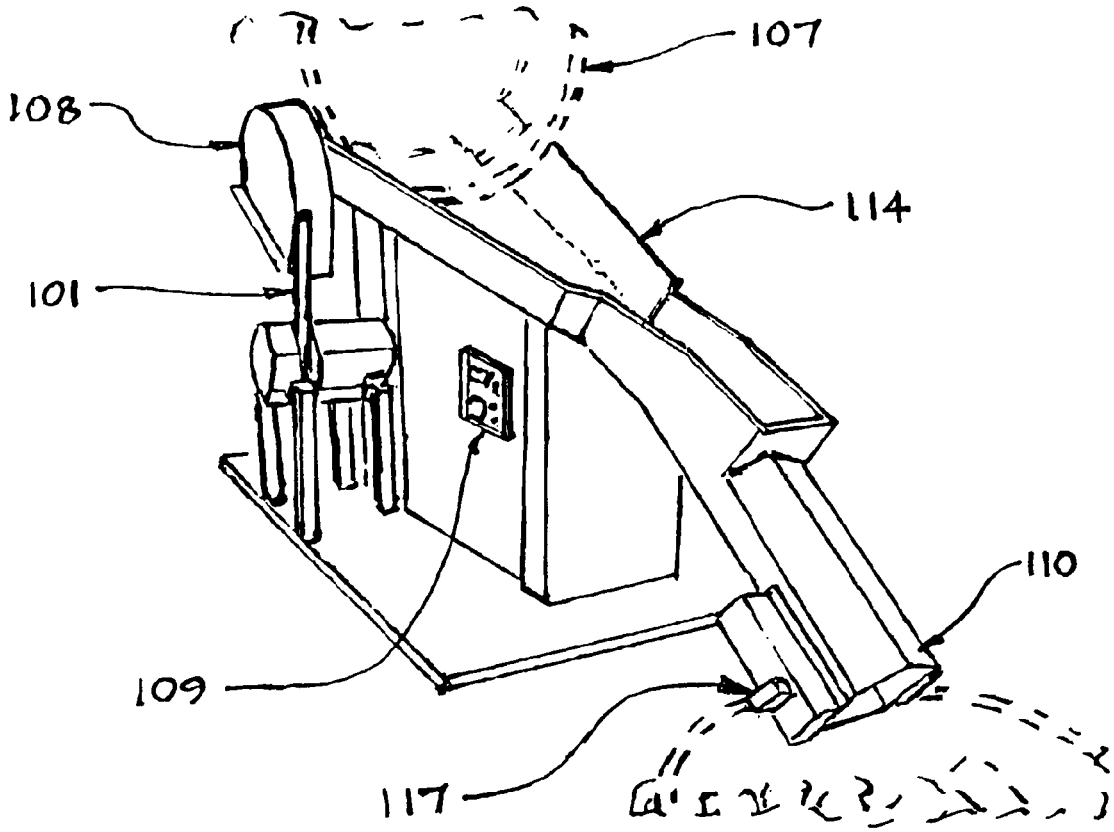
FIG. 11 is an end perspective view of the feeder channel portion thereof.

Referring to FIG. 11, shown is the straight feed channel 114, as opposed to the curved channel disclosed in the embodiment first discussed above. Containers flowing from the raised and inclined plastic barrel 107 are guided by the operator to flow down the feed channel 114 in single file through the sensor housing 110, where the photoelectric sensor 117 detects each passing container and sends a signal to the counters 111 and 116, which increment the count by one and display the running total.

Figure 12:
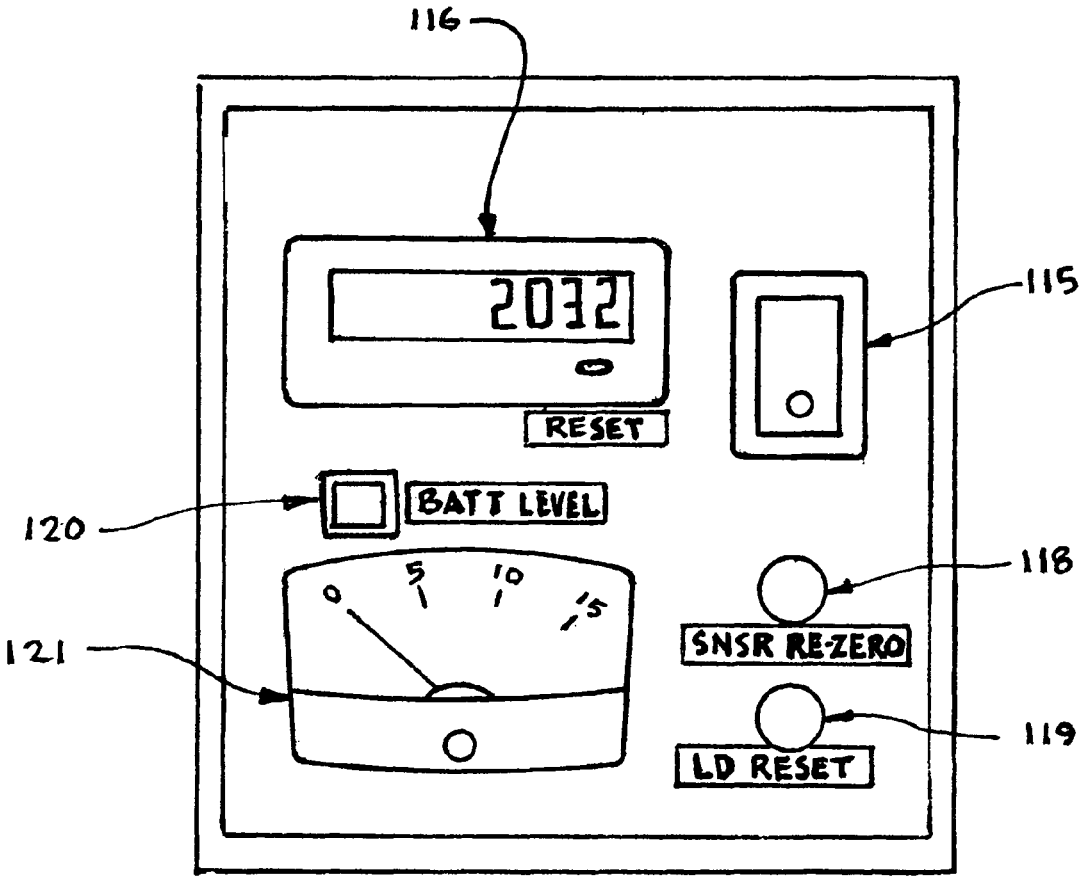
FIG. 12 is a front view of the control panel thereof.

FIG. 12 shows the presently preferred control panel, containing the same switches and displays as the embodiment first discussed above, except that the switch for the vibrator has been eliminated. The main power switch 115 illuminates an light emitting diode (LED) when power is on. The small display counter 116 has a reset button to reset the displayed count to zero. The photoelectric sensor re-zero push-button switch 118 remotely resets the photoelectric sensor (117 in FIG. 11) to the baseline, no-container condition. This will ensure that the sensor will accurately detect each container, including clear containers. The large display reset push-button switch 119 resets the large display (111 in FIG. 10) count to zero. The battery level push-button switch 120 activates the voltmeter 121 to indicate battery charge level.

Figure 13:
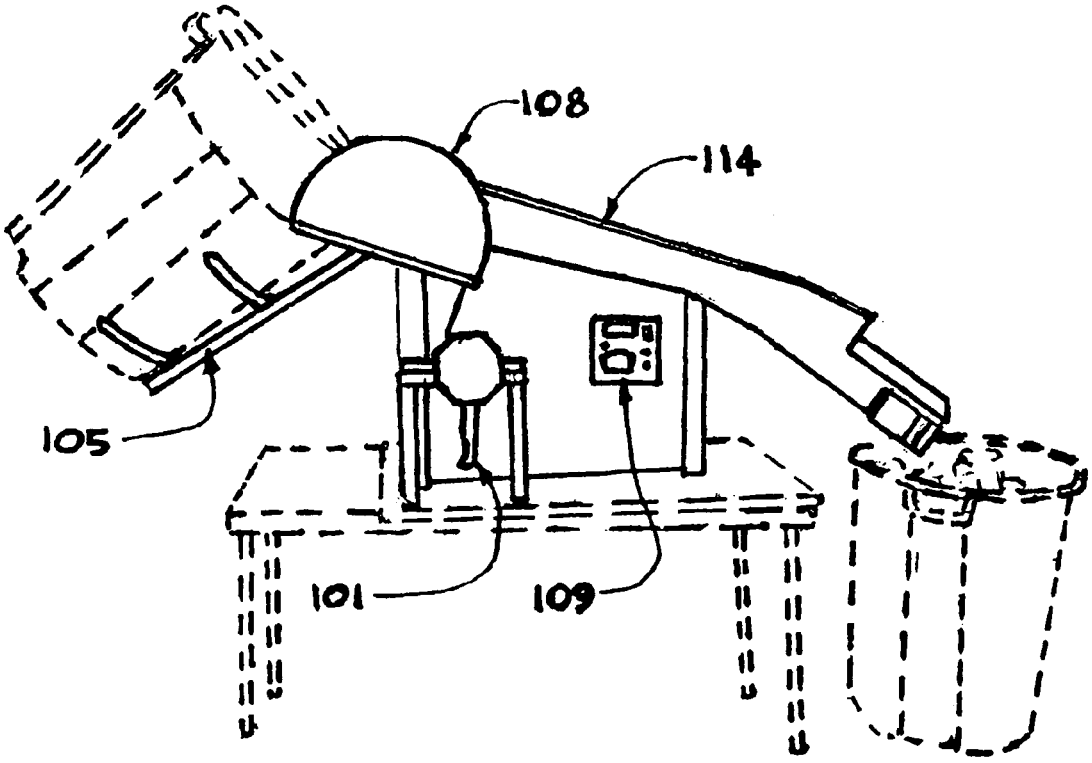
FIG. 13 is a side elevational view thereof, showing the load cradle and lift lever in the lowered position.

FIG. 13 shows a side elevational view of the presently preferred embodiment, with the lift lever 101 for raising the load cradle 105 shown in the lowered position.

Figure 14:
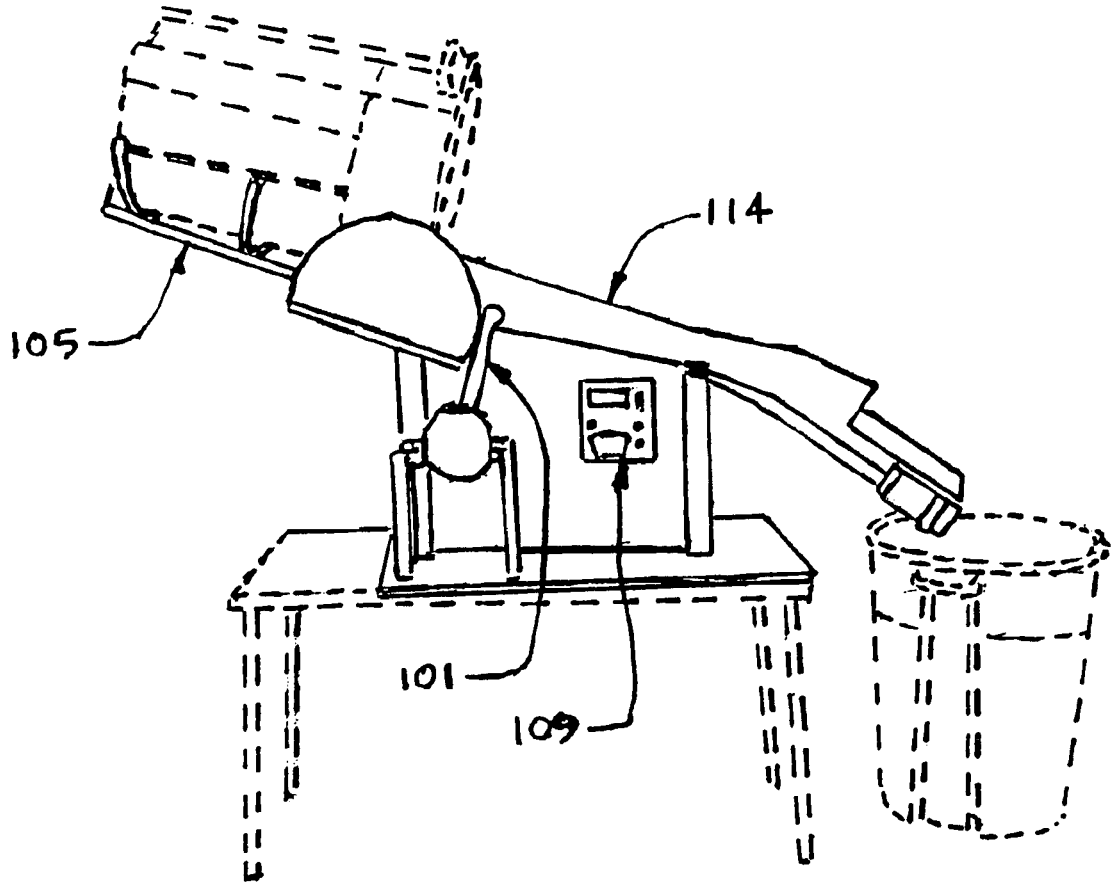
FIG. 14 is a side elevational view thereof, showing the load cradle and lift lever in the raised position.

FIG. 14 also shows a side elevational view of the presently preferred embodiment, but with the lift lever 101 for raising the load cradle 105 shown in the raised position.

The counters are connected to the sensor by wiring. All the electronic components have transistorized circuits and are designed for low voltage and low current. Power for all components is preferably provided by a rechargeable 12 volt DC sealed wet cell battery. The battery is preferably located in a steel sheet metal housing 18 adjacent to the pulley cover, as shown in FIG. 2. However, in the presently preferred embodiment, the battery is preferably located in an aluminum sheet metal enclosure located on the front side of the sheet aluminum base 122 as shown in FIG. 10. The housing preferably has a hinged door, allowing easy replacement or charging of the battery when it needs to be charged.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

The invention claimed is:

1. A device for counting deposit beverage containers, comprising:

a liftable loading basket into which said containers are loaded;

a downwardly inclined feed channel into which containers slide from said loading basket when said loading basket is lifted, said feed channel having an abrupt increase in downward inclination to singulate said containers as they slide down said feed channel;

a sensor operably connected to said feed channel after said abrupt change in inclination for counting singulated containers; and display counters for displaying the number of singulated containers that have passed by said sensor.

2. A device according to claim 1, wherein said loading basket comprises:

a load cradle configured to hold a barrel into which empty beverage containers are placed.

* * * * *